United States Patent [19]

Nakano et al.

[11] Patent Number: 4,774,912

[45] Date of Patent: Oct. 4, 1988

[54] COMPOSITE CYLINDER HEAD OF INTERNAL-COMBUSTION ENGINE

[75] Inventors: Hideaki Nakano; Yoichi Nakamura, both of Akashi; Tadahiro Ozu, Kobe; Toshio Atsuta, Akashi; Takeshi Yamada, Kobe, all of Japan

[73] Assignee: Kawasaki Jukogyo Kabushiki Kaisha, Hyogo, Japan

[21] Appl. No.: 913,234

[22] Filed: Sep. 30, 1986

[51] Int. Cl.[4] ..... F01P 3/14

[52] U.S. Cl. ..... 123/41.77; 123/41.82 A

[58] Field of Search ..... 123/193 H, 668, 41.72, 123/41.77, 41.82 A, 41.79

[56] References Cited

U.S. PATENT DOCUMENTS

| | | | |
|---|---|---|---|
| 1,731,228 | 10/1929 | Burtnett | 123/41.82 A |
| 2,003,571 | 6/1935 | Anderson | 123/41.82 A |
| 2,021,942 | 11/1935 | Loeffler | 123/41.82 A |
| 2,730,085 | 1/1956 | Brill | 123/41.82 A |
| 2,963,015 | 12/1960 | Caris | 123/41.82 A |
| 3,830,209 | 8/1974 | Jones et al. | 123/193 H |
| 3,960,121 | 6/1976 | Backus | 123/255 |
| 4,018,195 | 4/1977 | Bandrowski | 123/193 H |
| 4,106,444 | 8/1978 | Deutschmann et al. | 123/193 H |
| 4,344,390 | 8/1982 | Heydrich et al. | 123/193 CH |
| 4,387,678 | 6/1983 | Tholen | 123/193 CH |
| 4,453,527 | 6/1984 | Wade | 123/193 H |
| 4,524,732 | 6/1985 | Dworak et al. | 123/193 H |
| 4,646,692 | 3/1987 | Deuber et al. | 123/193 H |

FOREIGN PATENT DOCUMENTS

| | | | |
|---|---|---|---|
| 2946887 | 5/1981 | Fed. Rep. of Germany | 123/193 H |
| 0731013 | 4/1980 | U.S.S.R. | 123/193 H |

OTHER PUBLICATIONS

"Weiterentwicklung einer Baureihe mittelschnellaufender Diesel-motoren der Klöckner-Humboldt-Deutz AG", Hans Stadler, Motortechnische Zeitschrift 40 (1979) pp. 25-28 and 33-34.

*Primary Examiner*—Charles J. Myhre
*Assistant Examiner*—David A. Okonsky
*Attorney, Agent, or Firm*—Wenderoth, Lind & Ponack

[57] ABSTRACT

A composite cylinder head of an internal-combustion engine includes a bottom wall part to face the combustion chamber and a reinforcement part disposed on the side of the bottom wall part opposite to the combustion chamber and functioning as a back-up reinforcement of the bottom wall part. The two parts of the cylinder head are joined into a single integral structure. The bottom wall part is formed from a metal of higher high-temperature strength and lower thermal conductivity than those of the material of the reinforcement part. This cylinder head makes possible the use of a higher maximum pressure within the cylinder than that in the case of a conventional cylinder head.

7 Claims, 3 Drawing Sheets

COMPOSITE CYLINDER HEAD OF INTERNAL-COMBUSTION ENGINE

BACKGROUND OF THE INVENTION

This invention relates generally to cylinder heads for closing the outer or head end parts of cylinders of internal-combustion engines and forming combustion chambers. More particularly, the invention relates to a cylinder head of a composite construction comprising a bottom wall part to face the combustion chamber of the cylinder and a back-up or reinforcement part on the side of the bottom wall part opposite to the combustion chamber.

A typical cylinder head of conventional design, as will be described more fully hereinafter, is an integral structure ordinarily it the form of a casting of aluminum, cast iron, or some other suitable metal. It is a complicated structure comprising a bottom wall part facing and forming the outer end part of the combustion chamber, a reinforcement wall part extending from the bottom wall part away from the combustion chamber, and reinforcement ribs disposed within the reinforcement wall part, the wall parts and ribs forming a cooling water passage, air passages, and exhaust gas passages.

In recent years, the requirement for higher thermal efficiency and higher power output of internal-combustion engines has given rise to the necessity of elevating the maximum pressure within the cylinders of the engines. For example, the maximum pressure within a cylinder in Kawasaki-MAN two-cycle engines was of the order of 50 to 60 kfg/cm$^2$ in the 1950s but has risen to approximately 70 kgf/cm$^2$ in the 1960s and to approximately 90 to 110 kgf/cm$^2$ by 1980. In the case of Kawasaki-MAN four-cycle engines, the maximum pressure has been increased from approximately 90 kgf/cm$^2$ in 1956 to approximately 115 kgf/cm$^2$ in the 1960s and further to almost 150 kgf/cm$^2$ in the 1980s.

When, in view of the above necessity for increasing the maximum pressure, the conventional cylinder head of the above described structure is considered, it is seen that the thermal stress and the mechanical stress in the bottom wall part of the cylinder head increase. As will be apparent from a stress analysis set forth hereinafter, this means that, in order to prevent a rise in the thermal stress, it is necessary to keep the thickness of the bottom wall part from increasing. Furthermore, in order to prevent the mechanical stress from rising, it becomes necessary to decrease the spans between the reinforcement ribs and, at the same time, to increase the thickness of the bottom wall part.

It becomes clear from the analysis set forth hereinafter of the thermal and mechanical stresses that sufficient strength of the cylinder head to withstand elevated maximum pressures within the cylinder without incurring an increase in the two kinds of stresses can be attained by decreasing the spans of the reinforcement ribs without increasing the thickness of the bottom wall part.

However, in a conventional cylinder head of integral cast structure, there is a limit, due to difficulties in fabrication, to the reduction of the spans of the reinforcement ribs. For this reason it has not been heretofore feasible to increase amply the maximum pressure within engine cylinders.

SUMMARY OF THE INVENTION

This invention seeks to solve the above described problem by providing a composite cylinder head in which the spans between the reinforcement ribs can be made amply small, whereby the maximum pressure within the cylinder can be increased, and which, moreover, can be easily fabricated.

According to this invention, briefly summarized, there is provided a composite cylinder head of an internal-combustion engine comprising a bottom wall part to face the combustion chamber and a reinforcement part disposed on the side of the bottom wall part opposite to the combustion chamber and functioning as a back-up reinforcement of the bottom wall part, the cylinder head being characterized in that its two parts are respectively formed as separate structures and then joined into a single integral structure and in that the bottom wall part is formed from a metal of higher high-temperature strength and lower thermal conductivity than those of the material of the reinforcement part.

The nature, utility, and further features of this invention will be more clearly apparent from the following detailed description with respect to preferred embodiments of the invention when read in conjunction with the accompanying drawings, briefly described below.

DETAILED DESCRIPTION OF THE INVENTION

As conducive to, and perhaps essential for, a full understanding of the distinctiveness of this invention, the general nature and limitations of the conventional cylinder head will first be described with reference to FIGS. 5 through 8.

Figure 5:
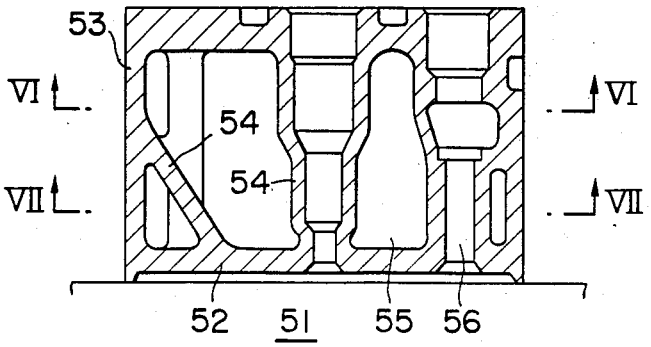
FIG. 5 PRIOR ART
FIG. 5 is a sectional view taken along a plane passing through the axis of a conventional cylinder head.
Figure 6:
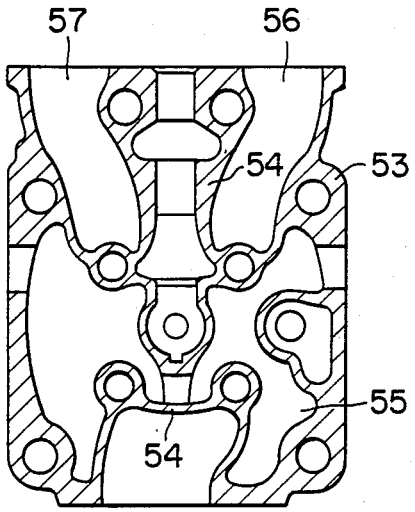
FIG. 6 PRIOR ART
FIGS. 6 and 7 are sections taken along the planes indicated by lines VI—VI and VII—VII, respectively, in FIG. 5 as viewed in the arrow directions.
Figure 7:
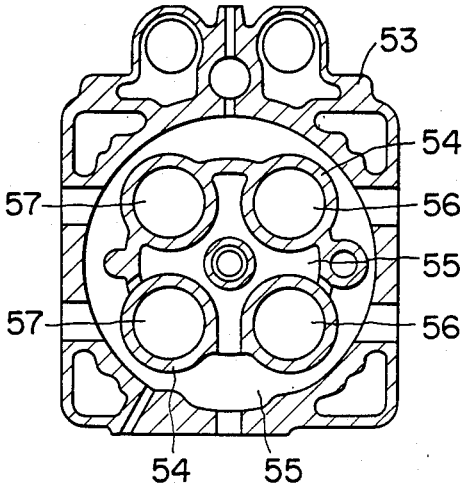
FIG. 7 PRIOR ART
Figure 8:
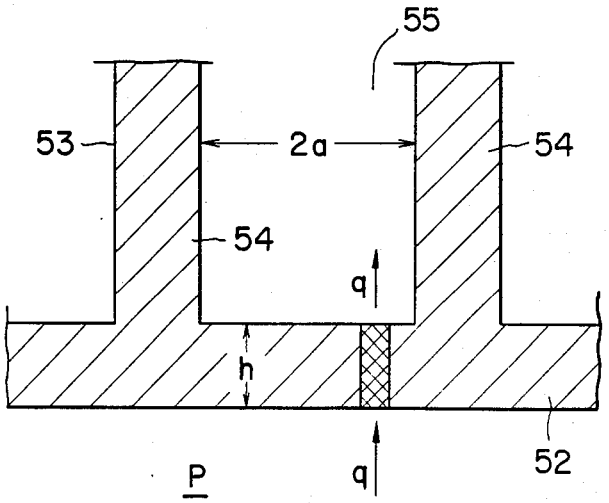
FIG. 8 is a sectional view showing a simplified model for an analysis of the stresses acting on a cylinder head.

As a typical example of the conventional cylinder head, that described in Japanese Utility Model Application Laid-Open Publn. (Kokai) No. 143539/1981 and Motortechnische Zeitschrift, Vol. 40, No. 1 (publ. January 1979), p. 27, is illustrated in FIGS. 5, 6 and 7. This cylinder head is of integral construction and has a bottom wall part 52 the lower surface of which faces the combustion chamber 51 of the engine (not shown) and reinforcement wall parts 53 extending from the bottom wall part 52 in the upward direction or away from the combustion chamber 51. In the reinforcement wall parts 53 are formed reinforcement ribs 54, by which a cooling water passage 55 is formed and separated from other passages and spaces. Within the reinforcement wall parts 53, furthermore, air passages 56 extending to the bottom wall part 52 and exhaust gas passages 57 are formed by the reinforcement ribs 54.

Because of its complicated structure as described above with respect to one example, the entire conventional cylinder head has been formed integrally as a casting of aluminum, cast iron, or like material.

As mentioned hereinbefore, the trend toward increasing the thermal efficiencies and power outputs of internal-combustion engines in recent years has necessitated the raising of the maximum pressures within the cylinders thereof. In the conventional cylinder head described above, this means that the thermal and mechanical stresses in the bottom wall part 52 increase. The nature of these stresses will now be studied with respect to the thermal stress $\sigma th$ and the mechanical stress $\sigma m$ by means of the simplified model shown in FIG. 8.

First, the thermal stress $\sigma th$ can be expressed as follows.

$$\sigma th \propto E \cdot \alpha \cdot q \cdot h / \lambda \propto h,$$

in which: E is the modulus of elasticity; $\alpha$ is the coefficient of linear expansion; $\lambda$ is the thermal conductivity; q is the heat flow density; and h is the wall thickness of the bottom wall part. From the above relationship, it is seen that, in order to prevent the rise of the thermal stress $\sigma th$, it is necessary to keep the wall thickness h from increasing.

On the other hand, the mechanical stress $\sigma m$ can be expressed as follows.

$$\sigma m \propto p \cdot (a/h)^2,$$

wherein: p is the maximum pressure within the cylinder; and a is the span of the reinforcement ribs 54. It is seen from the above relationship that, in order to prevent the mechanical stress from increasing, it is necessary that the span a of the reinforcement ribs 54 be small and that, at the same time, the wall thickness h be thick.

It is also apparent from the above two relationships that the maximum pressure within the cylinder can be increased without increases of the thermal and mechanical stresses $\sigma th$ and $\sigma m$ by reducing the span a of the reinforcement ribs 54 without increasing the wall thickness h of the bottom wall part 52 of the cylinder head.

However, as mentioned hereinbefore, in a conventional cylinder head of integral cast structure, there is a limit to the reduction of the span a of the reinforcement ribs 54, this limit being due to difficulties in fabrication. For this reason it has not been possible to increase amply the maximum pressure within engine cylinders.

This problem has been solved according to this invention by the provision of a cylinder head in which the spans of the reinforcement ribs are made amply small, whereby the maximum pressure within the cylinder can be increased, and which, moreover, can be easily fabricated.

Figure 1:
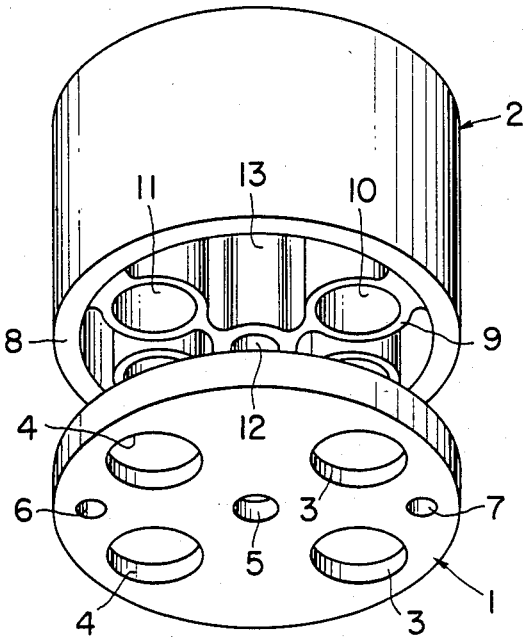
FIG. 1 is an exploded perspective view of a first embodiment of the cylinder head according to this invention.

In a first embodiment of the cylinder head according to this invention as illustrated in FIG. 1, the bottom wall part 1 and the reinforcement part 2 are formed separately but are adapted to be mutually joined. These parts can be joined by any suitable face-joining method such as the diffusion welding method, the hot hydrostatic-press method, the electron-beam welding method, or the friction (pressure) welding method.

By adopting the above described construction according to this invention, it becomes possible to freely select the span distances of reinforcement ribs 9 to be provided beforehand in the reinforcement part 2. For this reason, the spans of the reinforcement ribs 9 can be amply reduced, and it becomes possible to elevate the maximum pressure within the cylinder without increasing the thermal stress and mechanical stress thereby to increase the power output of the engine. Furthermore, since one end of the reinforcement part 2 is open before it is joined to the bottom wall part 1, the fabrication of the reinforcement part 2 is facilitated in the case where it is carried out by a process such as casting.

In a preferred mode of practice of this invention, the bottom wall part 1 and the reinforcement part 2 are formed from mutually different metals, the former being fabricated from a heat-resistant metal having a higher high-temperature strength and a lower thermal conductivity than the latter. Examples of such a heat-resistant metal are nickel alloys, austenitic stainless steels, and martensitic stainless steels. By this selection of metals, the mechanical and thermal strengths of the bottom wall part 1 facing the combustion chamber are greatly improved, and, at the same time, the bottom wall part has a heat-insulating effect, whereby the durability and thermal efficiency of the cylinder head, and therefore the engine, are increased.

In order to indicate more fully the distinctive nature and novel features of this invention specific examples of the cylinder head thereof will now be described in greater detail with reference to FIGS. 1 through 4.

In the first embodiment illustrated in FIG. 1, the cylinder head has a bottom wall part 1, the lower surface of which is disposed within and forms the ceiling of the combustion chamber, and a reinforcement part 2 on the side of the bottom wall part 1 remote from the combustion chamber. The bottom wall part 1 of disk shape is provided therethrough with holes 3 for air intake valves, holes 4 for exhaust valves, and a hole 5 for a fuel valve, a hole 6 for a starting valve, and a hole 7 for a safety valve. The reinforcement part 2 has an outer cylinder 8 of hollow cylindrical shape and reinforcement ribs 9 partitioning the interior of the outer cylinder into divisional passages, the principal passages being air intake passages 10, exhaust passages 11, a fuel passage 12, and cooling water passages 13.

Since the lower surface of the bottom wall part 1 faces and is disposed within the combustion chamber, the bottom wall part 1 is preferably formed from a highstrength material having low thermal conductivity and high heat resistance. Examples of preferred materials are: a nickel alloy such as Nimonic 80A (20 Cr - 1 Co - 2.5 Ti - 1.3 Al); an austenitic stainless steel (25 Cr - 20 Ni); and martensitic stainless steel (17 Cr - 7 Ni). The material is not necessarily limited to these metals, however. Furthermore, the bottom wall part 1 can be formed into the above described disk shape by a machining process such as turning but it can be formed also by casting or forging.

On the other hand, since the structure of the reinforcement part 2 is relatively complicated, it is preferably fabricated by casting a metal such as cast iron or cast steel, but it is also possible to produce a welded steel plate structure or to machine a steel block.

In joining the bottom wall part 1 and the reinforcement part 2, they are so placed in relative positions that the holes 3 through 7 the passages 10, 11 and 12, respectively, are coaxially aligned, and then the two parts 1 and 2 are integrally joined by joining the upper surface (as viewed in FIG. 1) of the bottom wall part 1 to the lower end part, that is, the lower end surfaces of the outer cylinder 8 and the reinforcement ribs 9, of the reinforcement part 2. For this joining, any of the aforementioned diffusion welding, hot hydrostatic-press method, electron-beam welding, friction (pressure) welding, and other methods can be used. Thereafter, when necessary, the structure thus obtained is further machined or otherwise finished into a cylinder head.

In the cylinder head according to this invention as described above, there are no dimensional limits as in a cylinder head fabricated by the conventional casting process. For this reason, the span distances of the reinforcement ribs can be freely selected, that is, they can be set at amply small values. As a result, it becomes possible to raise the maximum pressure within the cylinder and thereby to increase the engine power output without increase in the thermal stress $\sigma$th and the mechanical stress $\sigma$m of the bottom wall part 1 of the cylinder head. Furthermore, since the lower end part of the reinforcement part 2 is open before it is joined to the bottom wall part 1, its fabrication by a process such as casting is facilitated, and portions thereof where stress concentration tends to occur can be removed. Moreover, since flaws such as casting defects can be detected by inspection and corrected prior to the joining of the two parts, it becomes possible to produce cylinder heads of high quality.

In the case where the bottom wall part 1, which faces the combustion chamber, is formed from a high-strength, heat-resistant material of low thermal conductivity as described hereinabove, its mechanical and thermal strengths are greatly improved, and at the same time it exhibits a heat-insulating function. Moreover, by forming the bottom wall part 1 from a high-strength material, it can be made thin so as to withstand an increase in thermal stress. As a result, the durability and the thermal efficiency of the cylinder head, and therefore of the entire engine, are improved.

Figure 2:
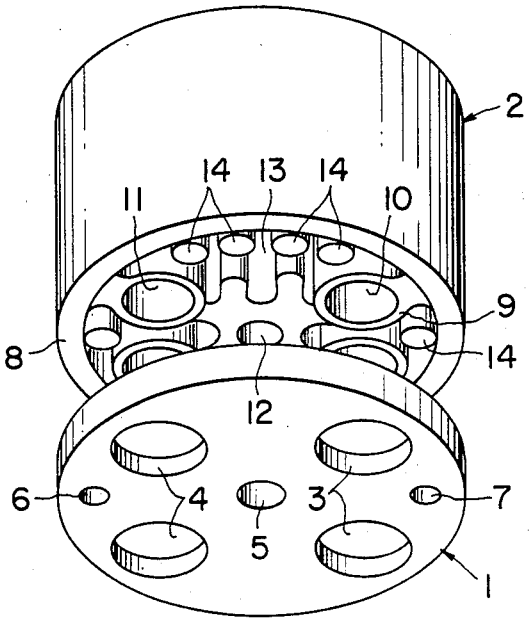
FIG. 2 is an exploded perspective view of a second embodiment of the cylinder head according to this invention.
Figure 3:
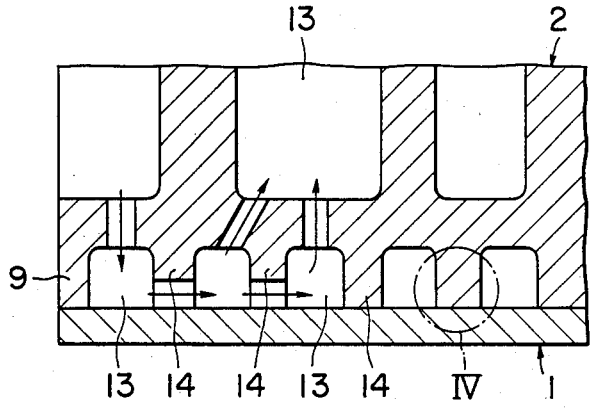
FIG. 3 is a sectional view taken along a plane parallel to the axis of the cylinder head of FIG. 2 and showing an essential part thereof.

In a second embodiment of the cylinder head of this invention as illustrated in FIGS. 2 and 3, the reinforcement part 2 is provided with a plurality of ribs 14 in addition to the aforedescribed reinforcement ribs 9, and the cooling water passages 13 are thereby finely divided. In other respects the cylinder head of this embodiment is similar to that of the preceding embodiment. Those parts in FIGS. 2 and 3 which are the same as or equivalent to corresponding parts in FIG. 1 are designated by like reference numerals, and description of such parts will not be repeated.

As indicated in FIG. 3, the cooling water passage 13 is finely divided by the ribs 14, particularly in the vicinity of the bottom wall part 1. By thus finely dividing the cooling water passage 13, the span distances between the ribs 9 and 14 are made smaller, and at the same time the flow velocity of the cooling water passing through the passage 13 is increased, whereby its cooling effectiveness is improved.

Figure 4:
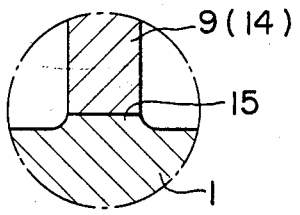
FIG. 4 is a fragmentary sectional view showing a modification of the mode of joining parts in the cylinder head illustrated in FIG. 3 and in the portion indicated by circle IV in the same figure.

While the foregoing embodiment of the invention illustrate the case wherein a disk-shaped bottom wall part 1 is used, and, to its upper surface, the lower end surfaces of the ribs 9 and 14 are abutted and joined, modified modes of joining are possible. For example, as indicated in FIG. 4, upwardly raised projections 15 are formed on the upper surface of the bottom wall part 1 to correspond in shape and position to and be in alignment with the outer cylinder 8 and the ribs 9 and 14 and are joined to the lower end surfaces of these parts.

While, in each of the above described embodiments of this invention the composite cylinder head is illustrated schematically in the drawings for the sake of simplicity and merely for the purpose of description, it is to be understood that in actual practice, of course, the cylinder head is so adapted as to be attachable by known methods to related parts such as the cylinder liner and the cylinder block, which are not shown.

As described above with respect to preferred embodiments of this invention, the cylinder head according to this invention is of a composite construction wherein a bottom wall part and a reinforcement part are first formed as separate structures and are then joined to form an integral structure. For this reason, the span distances of the reinforcement ribs previously provided in the reinforcement part can be set freely, that is, can be made amply small. As a result, the maximum pressure within the cylinder can be raised without causing an increase in the thermal and mechanical stresses, thereby to increase the power output and thermal efficiency of the engine. Furthermore, since one end of the reinforcement part prior to its joining to the bottom wall part is open, the fabrication of the reinforcement part is facilitated in the case where it is fabricated by casting, for example.

What is claimed is:

1. A cylinder head of an internal-combustion engine having a combustion chamber, said cylinder head comprising:

a reinforcement part having a planar bottom surface and internal cooling water passages formed so as to open along said bottom surface toward the combustion chamber;

a thin bottom wall part separate from said reinforcement part and formed in the shape of an entirely flat plate having upper and lower surfaces defined entirely as parallel upper and lower planar surfaces; and said bottom wall part being joined face-to-face at said upper planar surface thereof to said planar bottom surface of said reinforcement part by a face-joining method such that said cooling water passages are closed by said upper surface, and with the lower planar surface of the bottom all part directed away from said reinforcement part to face the combustion chamber.

2. A cylinder head according to claim 1 wherein the bottom wall part and the reinforcement part are respectively formed from mutually different materials.

3. A cylinder head according to claim 2 wherein the bottom wall part is formed from a material of higher high-temperature strength and lower thermal conductivity than those of the material of the reinforcement part thereby making it possible to increase the mechanical and thermal strengths and to reduce the thickness of said bottom wall part.

4. A cylinder head according to claim 3 wherein the bottom wall part is formed from a nickel alloy.

5. A cylinder head according to claim 3 wherein the bottom wall part is formed from an austenitic stainless steel.

6. A cylinder head according to claim 3 wherein the bottom wall part is formed from a martensitic stainless steel.

7. A cylinder head according to claim 3 wherein the reinforcement part is made of a cast steel.

* * * * *